United States Patent [19]

McGinley

[11] Patent Number: 4,877,162

[45] Date of Patent: Oct. 31, 1989

[54] BASEBALL GLOVE SHAPER

[76] Inventor: Michael L. McGinley, 5710 Cedar, Roeland Park, Kans.

[21] Appl. No.: 184,599

[22] Filed: Apr. 21, 1988

[51] Int. Cl.[4] ..... A41D 1/00; D06C 15/00

[52] U.S. Cl. ..... 223/78; 206/278

[58] Field of Search ..... 223/78, 79, 80; 2/19; 206/278, 315.1, 315.9

[56] References Cited

U.S. PATENT DOCUMENTS 2,281,741 5/1942 Boulard ..... 223/78 X 4,418,849 12/1983 Santa ..... 223/78

FOREIGN PATENT DOCUMENTS 538364 6/1922 France ..... 223/78

*Primary Examiner*—Andrew M. Falik

*Attorney, Agent, or Firm*—Kokjer, Kircher, Bradley, Wharton, Bowman & Johnson

[57] ABSTRACT

A device for initially shaping and maintaining the shape of the pocket of a baseball glove. Three pliable arms extend from a common junction and may be bent into the desired shapes. The arms curve along the palm area of the glove with one arm extending along the thumb and the other two arms extending along the finger section. Special tips on the arms are threaded through the laces of the glove to retain the device in place.

20 Claims, 1 Drawing Sheet

BASEBALL GLOVE SHAPER

BACKGROUND AND SUMMARY OF THE INVENTION

This invention relates generally to baseball gloves and more particularly to a device which functions to initially shape the glove pocket during the break-in period of the glove and to thereafter maintain the shape of the glove.

Baseball and softball gloves are ordinarily made of leather which is initially rather stiff. During the break-in period for new gloves, each player attempts to develop a pocket in the glove which has a size and shape that meets the individual preference of the player. Often, linseed oil or neat'sfoot oil is rubbed into the glove during the break-in period to condition the leather. Many players devote considerable time and effort to breaking the glove in properly. Even then, the pocket may not turn out exactly as desired. Even after the break-in period, the glove pocket may collapse or otherwise become misshapen due to careless handling or storage.

The present invention is directed to a device which can be applied to a ball glove in order to shape the glove and its pocket exactly as desired during the break-in period of the glove. The device is equally useful to maintain the shape of the glove after it has been broken in.

In accordance with the invention, a glove shaping device has a body formed by three connected arms or branches which extend from a common junction. Each arm has a stiff wire core surrounded by a cover that may be bent along in the wire. This construction allows the arms to be bent as desired and to remain in the shape to which they are bent. The arms can thus be bent to the desired configuration and applied to the ball glove with the junction area located in the palm of the glove and the arms extending along the thumb and fingers of the glove. The stiffness of the arms holds the glove in the shape defined by the device, and the pocket can thus be shaped as desired.

It is an important feature of the invention that the free ends of the arms have special tips that are threaded through the laces of the glove in order to secure the device in place. The tips may have spaced apart collars which allow the device to be used with gloves that differ in size and shape. The glove shaping device can be applied to properly shape the glove during the break-in period, and it functions thereafter to maintain the shape of the glove and prevent it from becoming deformed during times when it is stored.

DESCRIPTION OF THE DRAWINGS

In the accompanying drawing which forms a part of the specification and is to be read in conjunction therewith and in which like reference numerals are used to indicate like parts in the various views.

DETAILED DESCRIPTION OF THE INVENTION

Figure 1:
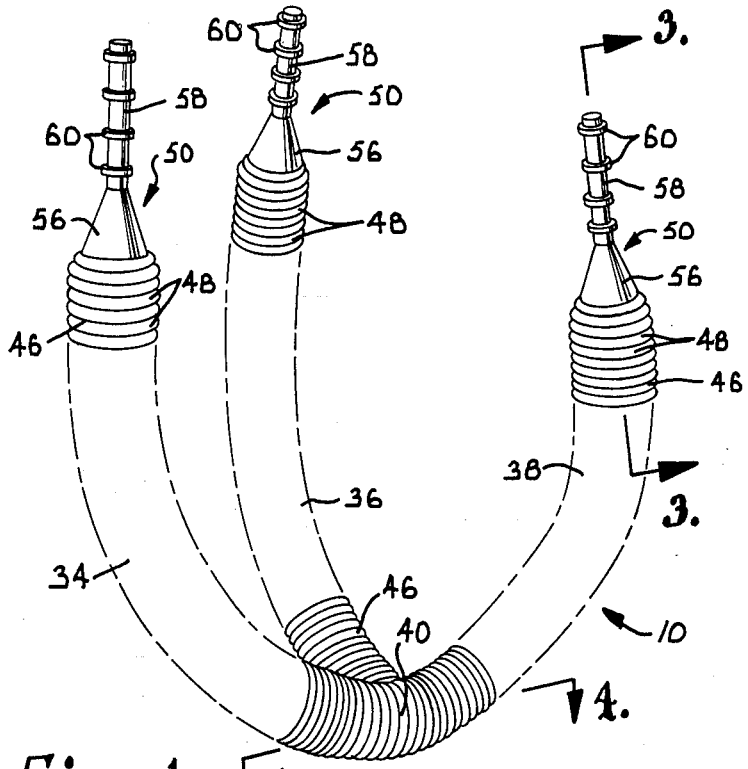
FIG. 1 is a perspective view of a glove shaping device constructed according to a preferred embodiment of the present invention, with the phantom line indicating continuous extension of the arms, or branches of the device.

Referring now to the drawing in more detail, numeral 10 generally designates a glove shaping device constructed in accordance with the present invention. The glove shaping device 10 may be used to properly shape a ball glove such as the baseball glove generally identified by numeral 12 in FIG. 2. The glove 12 may be a fielder's glove and may have a conventional construction. A palm area 14 is formed on the front surface of the glove. Extending from the palm area 14 are a thumb 16 and a finger section which includes an index finger 18, a middle finger 20, a ring finger 22 and a little finger 24. A flexible webbing 26 is located between the thumb 16 and the index finger 18. The webbing 26 is laced to the thumb 16 by laces 28 located near the tip of the thumb. The tips of the fingers 18–24 are connected to one another by laces 30. Additional laces 32 connect the index finger 18 with the adjacent webbing 26.

Figure 3:
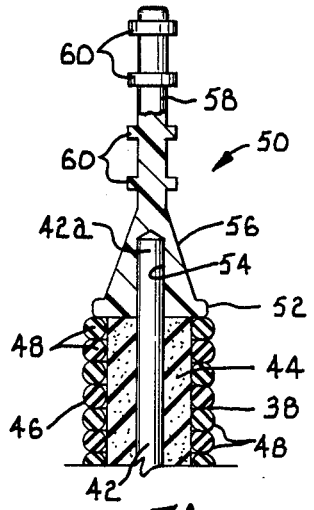
FIG. 3 is a fragmentary sectional view on an enlarged scale taken generally along line 3—3 of FIG. 1 in the direction of the arrows.
Figure 4:
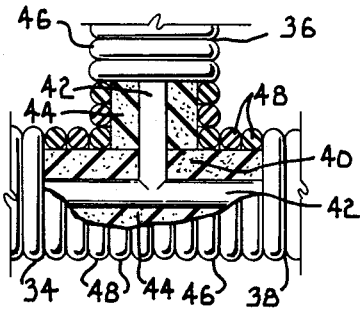
FIG. 4 is an enlarged fragmentary view, partially in section, taken generally along line 4—4 of FIG. 1 in the direction of the arrows.

The body of the glove shaping device 10 is formed by three elongated branches or arms 34, 36 and 38. The arms of the device are connected with one another at one end at a common intersection or junction 40 may take the form of a T. Arms 34 and 38 together present a generally U-shaped configuration, and the other arm 36 extends from the base of the U in a plane that is generally perpendicular to the plane which contains the U. Each arm 34, 36, and 38 has an identical construction which is best illustrated in FIGS. 3 and 4. Each arm has a relatively stiff wire 42 which forms the core of the arm and extends longitudinally through the center of the arm. The wire 42 is surrounded by a sleeve 44 which is formed from a relatively soft material such as foam rubber. A protective cover 46 in turn encloses the sleeve 44. The cover 46 may have any suitable configuration and may be constructed from any suitable material. In the form of the invention illustrated, the cover 46 is formed by a plurality of rubber 0 rings 48 which encircle the sleeve and provide the device with an attractive appearance. However, the cover may take other forms such as a sheath applied over the sleeve 44.

By virtue of this construction, each arm 34, 36 and 38 is pliable and can be bent to virtually any desired configuration. Both the sleeve 44 and the cover 46 are flexible enough to permit bending of the arm. The presence of the stiff wire core 42 causes each arm to retain whatever shape it is bent to. Each arm may be bent independently of the other arms.

Alternatively, the wire core may be encased in flexible material such as a rubber-like material injection molded around the wire. The exterior surface of the molded cover may have ribs which enhance the frictional effects between the glove and the device, as well as contributing to the appearance of the device.

The end of each arm 34, 36 and 38 remote from the junction 40 is a free end which is provided with a specially constructed tip generally identified by numeral 50. Each tip 50 is preferably formed by a single piece of plastic or other suitable material. Each tip has a disc shaped base 52 which is applied to the end of the corresponding arm and secured thereto by glue or in any other suitable manner. As shown in FIG. 3, the end 42a of wire 42 fits closely in a mating passage 54 formed in the tip 50. Each tip 50 has a tapered, frustoconical exterior surface 56 located outwardly of the passage 54. Extending from the small end of the frustoconical surface 56 is a straight pin element 58. Each pin 58 is considerably smaller in diameter than the corresponding arm which carries it. Each pin 58 is provided with a plurality of enlarged collars 60 which are spaced apart from one another along the length of the pin. The pins 58 are preferably constructed in a manner to bend so that they can be bent in a hook-like shape, as will be described more fully. It should also be pointed out that the tips 50 may be molded integrally as part of the cover which surrounds the wire core 42.

Figure 2:
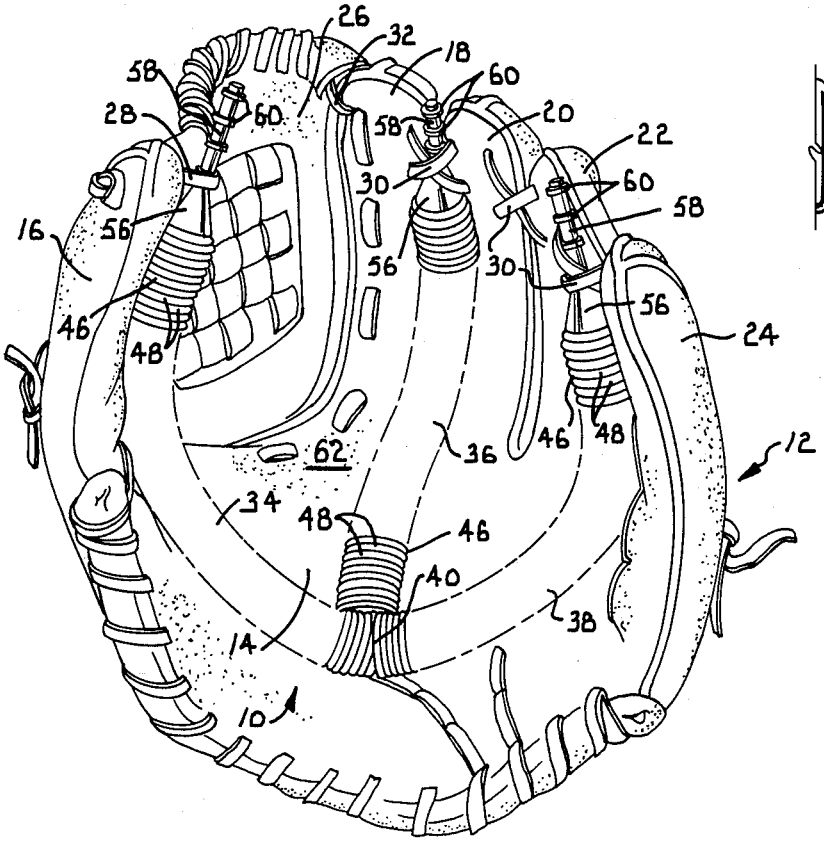
FIG. 2 is a perspective view showing the glove shaping device applied to properly shape a baseball glove.

In use, the device 10 may be applied to glove 12 generally in the manner shown in FIG. 2. The device is applied to the pocket area 62 of the glove with the junction 40 located on the palm 14 of the glove. Arm 34 extends along the palm 14 and generally along thumb 16 adjacent the intersection between the thumb and the webbing 26. Arm 36 extends along the palm 14 and along the finger section adjacent the intersection between the index finger 18 and the middle finger 20. The third arm 38 extends along the palm 14 and along the finger section of the glove adjacent the intersection between the ring finger 22 and the little finger 24.

The device 10 may be retained on the glove securely and yet releaseably by threading the pins 58 through the laces of the glove. The pin for arm 34 may be extended through the laces 28 which connect the thumb 16 with the webbing 26. The pin for arm 36 may be threaded through the laces 30 which connect the index finger with the middle finger. The pin for arm 38 may be threaded through the laces 30 which connect the ring finger with the little finger. Preferably, each pin is bent into a hook shape to help retain it threaded through the laces. When the pins have been threaded through the laces, the collars 60 help retain the pins in place and prevent them from inadvertently slipping back through the laces. The presence of a number of spaced apart collars 60 allows the glove shaping device 10 to be used with ball gloves that differ in size and shape. For example, if the glove has relatively long fingers, the laces may be positioned between the two collars 60 located nearest the free end of the pin. For shorter gloves, the laces may be positioned adjacent the lowermost collar 60.

The tapered configuration of the frustoconical surfaces 56 of the tips 50 provides for a gradual entry of the surfaces through the laces 28 and 30 and thus facilitates application of the device to the glove.

When the device 10 is applied to the glove 12 in this manner, it acts to hold the glove in a shape which is determined by the shapes of the arms 34, 36 and 38. Consequently, during the break-in period for the glove, the device 10 can be bent into the appropriate shape desired for the pocket area 62 of the glove which is located adjacent the base of the webbing 26 and which receives balls that are caught. By applying the device to the glove when it is not being used, the device conditions the glove and retains its pocket 62 in the desired shape so that the glove will thereafter tend to naturally assume the desired shape. Because the branches or arms 34, 36 and 38 can be bent into virtually any desired shape, the device can provide the pocket area 62 of the glove with virtually any desired size and shape.

After the break-in period, the device 10 should be applied to the glove during times when the glove is not in use and is being stored. This helps to maintain the glove in shape even after the break-in period and prevents the pocket from collapsing or becoming unduly creased as time passes. Consequently, the useful life of the glove is prolonged.

In this manner, each glove can be provided with a pocket that has a size and shape "custom tailored" to the individual preference of each player. It should be noted that the second and third arms 36 and 38 can be applied to areas of the finger section of the glove different from those illustrated in the drawing. For example, arm 36 may be threaded through the lacing 32 which connects the index finger 18 with the webbing 26. Similarly, arm 38 may be applied to the lacing 30 between the middle and ring fingers of the glove or to any other desired area that will result in the pocket assuming the desired configuration. The fingers of the glove can be curved as much as desired, and the tips of its fingers can be bent more or less toward the thumb, depending on the preference of the player. The device can be provided with more than three arms if desired, although three arms usually suffices. In addition, the device can be used with a first baseman's glove which has a single finger section instead of the individual, fingers that are generally provided on a fielder's glove. Softball gloves and other ball gloves can likewise be shaped by the device.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for shaping a ball glove having a palm, a thumb extending from the palm, a finger section extending from the palm, a webbing between the thumb and finger section, and laces interconnecting the webbing with the thumb and with the finger section, said device comprising:

at least three elongate arms including first, second and third arms interconnected in a manner permitting application of said arms to the glove with one end of each arm applied to the palm of the glove, each arm having a free end opposite said one end; and each arm being pliable and constructed to retain the shape of which it is bent to permit the first arm to curve along the palm and generally between the thumb and webbing, the second arm to curve along the palm and along the finger section and the third arm to curve along the palm and along the finger section at a location more remote from the webbing than the second arm, whereby the arms cooperate to hold the glove in a configuration to present a ball receiving pocket adjacent the webbing.

2. The device of claim 1, wherein said arms are interconnected at a common junction applicable to the palm of the glove.

3. The device of claim 1, including means on the free end of each arm for releaseably holding the free end to the glove.

4. The device of claim 1, including a tip on the free end of each arm threadable through the laces to releaseably secure the tip to the laces.

5. The device of claim 4, wherein the tip of each arm comprises a pin which may be bent.

6. The device of claim 5, including a plurality of enlarged collars on each pin spaced apart from one another to assist in holding the pin threadable through the laces.

7. The device of claim 4, including a tapered surface on each arm adjacent the tip thereof.

8. The device of claim 1, wherein each arm comprises:

a stiff wire core; and a relatively soft sleeve surrounding said wire core.

9. The device of claim 8, including a covering surrounding the sleeve of each arm.

10. A device for shaping a ball glove having a palm, a thumb extending from the palm, a finger section extending from the palm, a webbing between the thumb and finger section, and laces interconnecting the webbing with the thumb and with the finger section, said device comprising:

at least three elongate arms connected with one another at a junction and each having a free end remote from the junction, each arm being pliable and constructed to retain the shape to which it is bent;

a tip on the free end of each arm arranged to be threaded through the laces to retain the tip adjacent the laces, each tip having a plurality of enlarged collars spaced apart thereon to assist in retaining the tip threaded through the laces; and said arm being applicable to the glove with said junction located against the palm, one arm curving from the palm along the thumb with the tip of said one arm threaded through the laces between the thumb and webbing, and the other two arm curving from the palm along said finger section at spaced apart locations with the tips of said other two arms threaded through the laces adjacent said finger section, whereby said arms cooperate to hold the glove in a configuration to present a ball receiving pocket adjacent the webbing.

11. The device of claim 10, including a conical surface on each arm adjacent the tip thereof.

12. The device of claim 10, wherein each tip comprises a pin element.

13. The device of claim 10, wherein each arm comprises:

a stiff wire core; and a relatively soft sleeve surrounding said wire core.

14. The device of claim 13, including a covering enclosing sleeve of each arm.

15. A device for shaping a ball glove having a palm, a thumb extending from the palm, a plurality of fingers extending side by side and connected by laces, and a webbing located between the thumb and fingers and connected therewith by laces, said device comprising:

a shaper body having first, second and third elongate arms interconnected at a junction and each terminating in a free end remote from the junction, each arm including a stiff wire which can be bent and which retains the shape to which it is bent;

said body being applicable to the glove with said junction on the palm, said first arm extending generally along the thumb and said second and third arms extending generally along different fingers;

each arm assuming a curved shape to retain the glove in a configuration to present a ball receiving pocket adjacent the webbing; and a pin on said free end of each arm shaped to be threaded through the laces in a manner to releaseably secure the pins to the laces.

16. The device of claim 15, including a tapered surface on each arm adjacent the pin thereon.

17. The device of claim 16, including a plurality of enlarged collars on each pin spaced apart thereon to assist in retaining the pin threaded through the laces.

18. The device of claim 15, wherein each arm comprises:

a stiff wire core; and a relatively soft sleeve surrounding said wire core.

19. The device of claim 15, including an end piece on said free end of each arm, each end piece carrying said pin thereon and including a tapered surface extending between the pin and the remainder of the arm.

20. A device for shaping a ball glove having a palm, a thumb extending from the palm, a finger section extending from the palm, a webbing between the thumb and finger section, and laces interconnecting the webbing with the thumb and with the finger section, said device comprising:

at least three elongate arms including first, second and third arms interconnected in a manner permitting application of said arms to the glove with one end of each arm applied to the palm of the glove, each arm having a free end opposite said one end, and a tip on said free end threadable through the laces to releaseably secure the tip to the laces, each tip comprising a pin which may be bent; and each arm being pliable and constructed to retain the shape of which it is bent to permit the first arm to curve along the palm and generally between the thumb and webbing, the second arm to curve along the palm and along the finger section and the third arm to curve along the palm and along the finger section at a location more remote from the webbing than the second arm, whereby the arms cooperate to hold the glove in a configuration to present a ball receiving pocket adjacent the webbing.

* * * * *